US006965750B2

(12) United States Patent
Muratani

(10) Patent No.: US 6,965,750 B2
(45) Date of Patent: Nov. 15, 2005

(54) IMAGE FORMING APPARATUS

(75) Inventor: Masataka Muratani, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/689,080

(22) Filed: Oct. 21, 2003

(65) Prior Publication Data

US 2005/0084307 A1 Apr. 21, 2005

(51) Int. Cl.[7] ..... G03G 15/00; G03G 21/20; B65H 29/70

(52) U.S. Cl. ..... 399/406; 399/44; 399/45; 399/92; 271/188; 271/197; 271/209

(58) Field of Search ..... 399/406, 44, 45, 399/92; 271/188, 197, 209; 162/271

(56) References Cited

U.S. PATENT DOCUMENTS

| | | | | |
|---|---|---|---|---|
| 4,427,285 | A * | 1/1984 | Stange | 399/306 |
| 5,146,286 | A * | 9/1992 | Rees et al. | 399/381 |
| 5,392,106 | A * | 2/1995 | Bigenwald et al. | 399/406 |
| 5,414,503 | A * | 5/1995 | Siegel et al. | 399/406 |
| 5,519,481 | A * | 5/1996 | Kuo | 399/406 |
| 5,787,331 | A * | 7/1998 | Ohkuma et al. | 399/406 |
| 5,839,035 | A * | 11/1998 | Rathbun | 399/181 |
| 5,920,759 | A * | 7/1999 | Ushiroji et al. | 399/406 |
| 5,941,518 | A * | 8/1999 | Sokac et al. | 271/10.05 |
| 5,970,274 | A * | 10/1999 | Rath | 399/21 |
| 5,974,290 | A * | 10/1999 | Inoue | 399/124 |
| 6,473,592 | B2 * | 10/2002 | Nishio | 399/406 |
| 2001/0033762 | A1 * | 10/2001 | Nishio | 399/406 |

FOREIGN PATENT DOCUMENTS

| | | |
|---|---|---|
| JP | 6-144679 A | 5/1994 |
| JP | 2003-066744 A | 3/2003 |

* cited by examiner

*Primary Examiner*—Andrew H. Hirshfeld
*Assistant Examiner*—Marvin P Crenshaw
(74) *Attorney, Agent, or Firm*—Foley & Lardner LLP

(57) ABSTRACT

An image forming apparatus of this invention is provided with a conveying guide that is curved in the direction reverse to the curved shape of a nip portion of a fixing unit in order for leading sheet paper that is vertically conveyed at the time of fixing in the horizontal direction and the top of the curved portion of the conveying guide is constructed with a guide belt. The contacting force of the curl correction unit with the guide belt of the curl correction unit is adjusted according to amount of curl of sheet paper produced at the time of fixing and corrects the curve of sheet paper properly.

12 Claims, 2 Drawing Sheets

IMAGE FORMING APPARATUS

BACKGROUND OF THE INVENTION

1. Field of the Invention

This invention relates to an image forming apparatus that corrects curl produced on a sheet paper when forming a toner image on the sheet paper.

2. Description of the Related Art

In an electro-photographic image forming apparatus such as a copying machine, a printer and the like, a fixing unit that fixes a toner image formed on a sheet paper by conveying a sheet paper, heating and pressurizing a toner image formed thereon with a pair of fixing rollers is widely used. In this fixing unit, to supply sufficient heat to a toner image, a prescribed nip is formed between the fixing rollers and a satisfactory fixing is obtained by supplying a sheet paper through this nip.

However, after fixing a toner imager, a sheet paper may be curled along the nip shape of the fixing rollers and when tried to discharge a curled sheet paper, it can be bent for defective paper discharge or a sheet paper discharged preceding may disturb the discharge of a succeeding sheet paper. For correcting such curling of a sheet paper, a curl correction unit that controls the pressing force of a pressing roller to press a sheet paper against a belt by a cam is disclosed in Japanese Patent Disclosure No. 6-144679. In addition, an image forming apparatus with two curl correction means arranged at the downstream of a fixing means to correct curl properly according to the direction of curl of recording media is disclosed in Japanese Patent Disclosure No. 2003-66744.

However, both of the above-mentioned curl correction unit and the curl correction means are for correcting sheet paper curl while sheet paper is conveyed linearly and a long path is required.

On the other hand, the downsizing of an image forming apparatus is demanded in recent years in spite of such high function as correspondence to high speed color image forming. Therefore, in order to make the sheet paper conveying distance short, an apparatus to transfer and fix a toner image while conveying sheet paper supplied from a lower paper supply cassette in the vertical direction and then, discharge the sheet paper by guiding in the horizontal direction is developed. In such a small size apparatus, a space for discharge sheet paper conveyed in the vertical direction to the horizontal direction is limited. Therefore, the downsizing is demanded for a curl correction unit for correcting the curl of sheet paper after fixing and its installing space is restricted.

Accordingly, an image forming apparatus that is small in size and can be arranged in a limited space but is capable of properly correcting the curl produced on sheet paper when fixing an image and achieving a satisfactory conveying and discharging sheet paper is demanded.

SUMMARY OF THE INVENTION

It is an object of this invention to correct a curl produced on a sheet paper, convey and discharge that sheet paper satisfactorily without impairing the downsizing of an image forming apparatus.

According to an embodiment of this invention, the image forming apparatus comprises: an image forming unit to form an unfixed toner image on a recording medium, a fixing unit to fix the unfixed toner image by heating and pressurizing it while conveying the recording medium with the unfixed image formed thereon in the first direction by clamping it with a curved nip portion, a conveying guide provided at the downstream of the fixing unit, curved in the direction reverse to the curve of the nip portion to guide the recording medium to a second direction crossing the first direction, a stacking unit to stack the recording medium guided by the conveying guide, and a curl correction unit that is in contact with the conveying guide and changes an angle of curve of the conveying guide by adjusting the contact force with the conveying guide.

DETAILED DESCRIPTION OF THE INVENTION

An embodiment of this invention will be described below in detail referring to the attached drawings.

Figure 1:
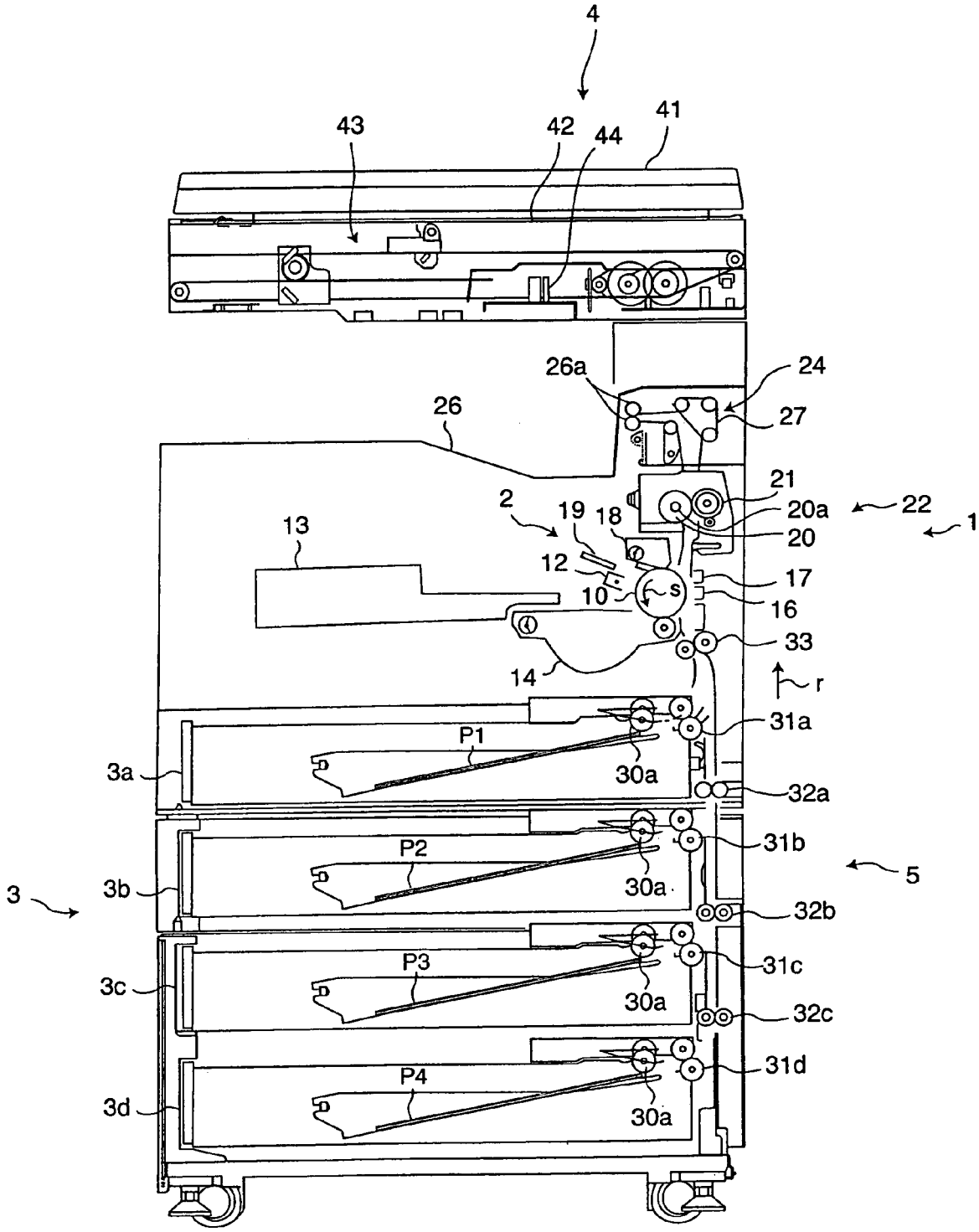
FIG. 1 is a construction diagram schematically showing a copying machine involved in an embodiment of this invention.

FIG. 1 is a schematic construction diagram showing the entirety of a monochromatic copying machine 1 that is an image forming apparatus involved in an embodiment of this invention. In this copying machine, there is provided a paper supply unit 3 having paper supply cassettes 3*a*, 3*b*, 3*c* and 3*d* to supply sheet paper P that are recording media in the direction of a developing image forming unit 2. On the top surface of the copying machine 1, there is provided a scanner 4 that reads an original image.

Paper supply cassettes 3*a*, 3*b*, 3*c* and 3*d* house A4, A4R (conveyed in the long side direction) and A3 size ordinary sheet paper P1, P2 and P3, respectively. Here, P2 is ordinary thin paper (65 g/m$^2$). Paper supply cassette 3*d* houses A4 size special thick sheet paper P4 (200 g m$^2$). Between paper supply cassettes 3*a*, 3*b*, 3*c*, 3*d* and developing image forming unit 2, there is a conveying path 5 equipped with pickup rollers 30*a*, 30*b*, 30*c* and 30*d* to pick up sheet paper P in paper supply cassettes 3*a*, 3*b*, 3*c* and 3*c*, separation rollers 31*a*, 31, 31*c* and 31*d*, first~third conveying rollers 32*a*, 32*b*, 32*c* and an alignment roller 33. This conveying path 5 is arranged in the vertical direction that is a first direction and conveys sheet paper P taken out of paper supply cassettes 3*a*, 3*b*, 3*c* and 3*d* in an arrow direction r.

Scanner 4 has a document glass 42 to place a document thereon, a platen 41 to cover document glass 42, an optical unit 43 to apply light to a document and collect reflected light from a document, and a CCD scanner unit 44 to read light from optical unit 43.

Image forming apparatus 2 is equipped with a charging unit 12 to uniformly charge a photo-conductive drum 10 according to the rotating direction of an arrow mark "s" around photo-conductive drum 10, a laser exposure unit 13 to form a latent image based on image data from scanner unit 4 on photo-conductive drum 10, a developing unit 14, a transfer charger 16, a separation charger 17, a cleaning unit 18, and a charge elimination LED 19. Charging unit 12, developing unit 14, cleaning unit 18 and charge elimination LED 19 are unitized and incorporated into image forming apparatus.

Further, at the downstream in the sheet paper P conveying direction of developing image forming unit 2, there is a fixing unit 22 to heat, pressurize and fix unfixed toner image by conveying a sheet paper P while clamping it with a nip unit 23 formed by a heat roller 20 having a built-in heater lamp 20*a* and a press roller 21. Heat roller 20 has a surface layer comprising heat resistive rubber of surface hardness 45° (ASKER-C) and the like. Press roller 21 has a surface layer comprising heat resistive rubber of surface hardness 80° (ASKER-C) and the like. Accordingly, between heat roller 20 and press roller 21, a nip portion with heat roller 20 of which surface is curved in the concave shape is formed.

Normally, for a fixing unit, fixing conditions including fixing temperature, fixing pressure of a press roller or sheet paper conveying velocity and the like are set according to image forming conditions. Image forming conditions including paper size, paper material or black and white ordinary paper mode in the case of a color copying machine or image forming mode of in the case of full color thick paper mode and the like can be set optionally by an image forming apparatus.

In fixing unit 22, the lighting range of heater lamp 20*a* is set according to size of sheet paper P. Fixing unit 22 sets heater lamp 20*a* to light in the width of A4 longer side size when paper supply cassette 3*a* is selected from a control panel (not shown) when the image forming is started, in the width of A4 shorter side size when paper supply cassette 3*b* is selected, and in the width of A3 shorter side size when paper supply cassette 3*c* is selected. Further, in the case of thick sheet paper P, heating temperature of heater lamp 20*a* is set high. When paper supply cassettes 3*a*~3*c* are selected from the control panel when starting the image forming, fixing unit 22 sets heater lamp 20*a* to rise up to 155~185° C. and when paper supply cassette 3*d* is selected, set heater lamp 20*a* to rise to 185~215° C.

Figure 2:
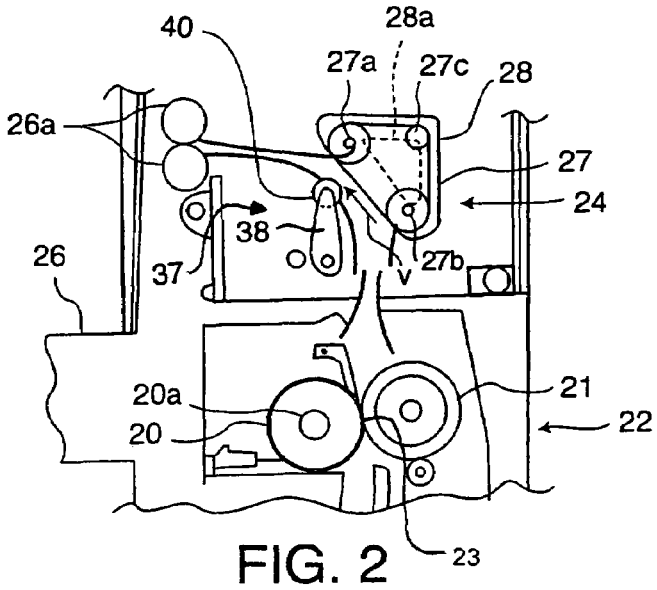
FIG. 2 is a construction diagram showing a conveying guide and a curl correction unit at the home position involved in an embodiment of this invention.

At the downstream of fixing unit 22, there are a conveying guide 24 to guide sheet paper P conveyed in the vertical direction after fixing by fixing unit 22 in the horizontal direction and a discharging roller 26*a* to discharge sheet paper P onto a receiving tray 26 as shown in FIG. 2. Conveying guide 24 has a curve in the direction reverse to the curved shape of nip portion 23. The top portion of conveying guide 24 is composed of a guide belt 27 that is stretched between first~third rollers 27*a*, 27*b* and 27*c* and rotates in the arrow direction v.

Guide belt 27 is made of base material of thin and highly heat conductive metal, for instance, 0.04 mm thick nickel metal and the like with resin coated when necessary. On a frame 28 supporting rollers 27*a*, 27*b* and 27*c* at both sides of guide belt 27, a ventilation hole 28*a* is formed. This hole 28*a* is connected to a duct 36*a* of a fan 36.

The air from duct 36*a* by fan 36 is blasted against the outer and inner surfaces of guide belt 27.

On the curved top inside of conveying guide 24, there is a curl correction unit 37. This curl correction unit 37 has a curl correction roller 40 that is provided at the tip of a rotatable lever 38 and changes an angle of the curve of conveying guide 24 by contacting and making guide belt 27 curve. Curl correction unit 37 makes the position shown in FIG. 2 as a home position. Lever 38 is rotated by the force in the arrow direction of a spring (not shown) provided in a shaft 38*a* and the driving of a cam 41 that is an adjusting device.

Amount of curl produced on sheet paper P during the fixing differs depending on fixing conditions of fixing unit 22. When a curl amount of sheet paper P is small, a small curl correction action is sufficient and a curve angle of conveying guide 24 can be large. However, when a curl amount of sheet paper P is large, it is necessary to make a curve angle of conveying guide 24 deep in order to make the curl correction action large.

Therefore, the driving of cam 41 is adjustable according to not only fixing conditions but also image forming conditions that are input through the control panel when starting the image forming. When paper cassettes 3*a* and 3*c* are selected when starting the image forming, cam 41 is at the position shown by the solid line in FIG. 4 and moves to the position shown by the dotted line in FIG. 4 when paper cassettes 3*b*, 3*d* are selected.

This is because heat quantity applied to A4R size thin ordinary sheet paper P2 or A4 size special thick sheet paper P4 from heat roller 20 during the fixing process is much and a curl amount produced on sheet paper P2, P4 is large. Thus, it is necessary to make guide belt 27 bent and a curve angle of conveying guide 24 deep.

When at the home position, curl correction roller 40 is separated from guide belt 27 and guide belt 27 is not subject to deformation. When cam 41 is at the position shown by the dotted line shown in FIG. 4, curl correction roller 40 is kept in contact with guide belt 27 at a strong contacting force and make guide belt 27 bent and the curve angle of conveying guide 24 deep.

Figure 4:
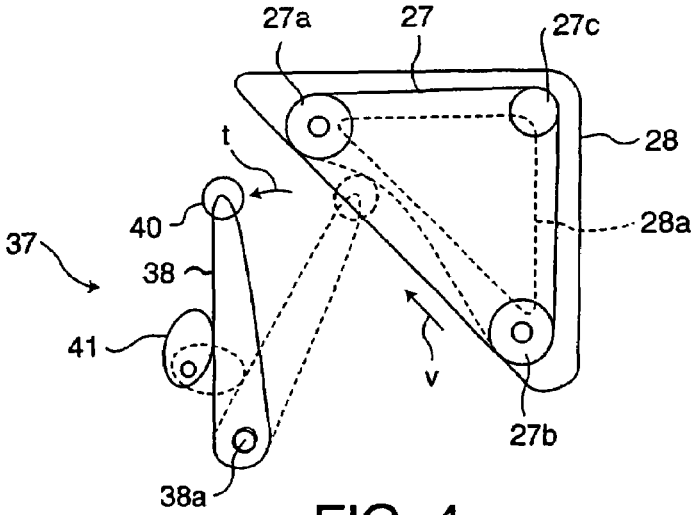
FIG. 4 is a construction diagram showing a curl correction unit.

Further, cam 41 is adjusted so that it does not move to the position shown by the dotted line in FIG. 4 from the beginning when paper supply cassette 3*d* is selected but is waiting at the position shown by the solid line in FIG. 4 until the leading edge of sheet paper P reaches the position of curl correction roller 40, and moves to the position of curl correction roller 40 shown by the dotted line in FIG. 4 when the leading edge of sheet paper P reaches the position of curl correction roller 40.

Figure 3:
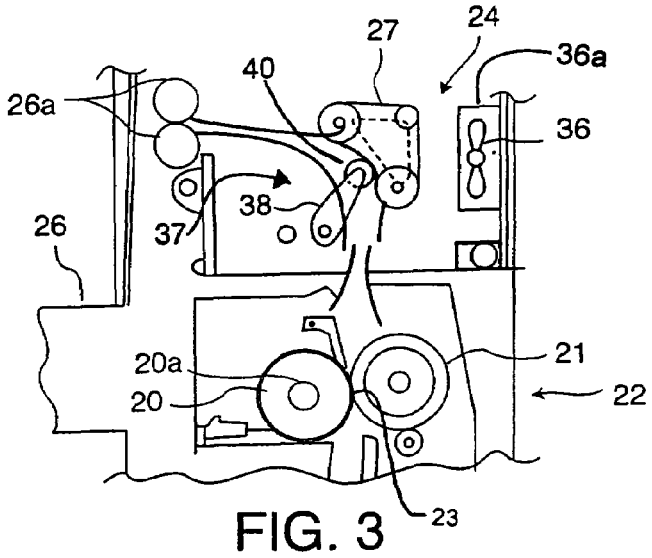
FIG. 3 is a construction diagram showing a conveying guide and a curl correction unit at a position in contact with a guide belt involved in an embodiment of this invention.

Next, the image forming process by copying machine 1 will be explained. Image forming conditions are input through the control panel when starting the image forming process. When supply paper cassette 3*a* is selected, in fixing unit 22, heater lamp 20*a* is set at heating temperature 155~185° C., the A4 long side size lighting width and curl correction unit 36 is positioned at the home position. When paper supply cassette 3*b* is selected, in fixing unit 22, heater lamp 20*a* is set at heating temperatures 155~185° C., the A4 short side size lighting width and curl correction unit 37 is moved to the position shown in FIG. 3. When paper supply cassette 3*c* is selected, in fixing unit 22, heater lamp 20*a* is set at heating temperatures 155~185° C., the A3 short side size lighting width and curl correction unit 37 is positioned at the home position. When paper supply cassette 3*d* is selected, in fixing unit 22, heater lamp 20*a* is set at heating temperatures 185~215° C. and the A4 long side size lighting width. Curl correction unit 37 is set so as to position first at the home position and move to the position shown in FIG. 3 after the leading edge of sheet paper P reaches curl correction roller 40.

When the image forming process starts, scanner unit 4 reads a document. In developing image forming unit 2, photo-conductive drum 10 is uniformly charged by charging unit 12 according to its rotation in the arrow direction "s" and after applied with laser beam by laser exposure unit 13 according to a document image and an electrostatic latent image is formed. Then, the electrostatic latent image formed on photo-conductive drum 10 is developed by developing unit 14 and transferred on a sheet paper P by transfer charger 16. The sheet paper P is conveyed to the position of transfer charger 16 from paper supply unit 3 in sync with a toner image on photo-conductive drum 10.

After a toner image is transferred, sheet paper P is separated from photo-conductive drum 10 by separating charger 17. After sheet paper P is separated, residual toner left on photo-conductive drum 10 is cleaned by cleaner unit 18, residual charge is removed by charge elimination LED 19, and a next image forming process is waited. A sheet paper P with an unfixed toner image formed and separated from photo-conductive drum 10 passes through nip portion 23 between heat roller 20 and pressing roller 21 of fixing unit 22 and while clamped and conveyed, the toner image formed thereon is heated, pressurized and fixed according to fixing conditions set according to kind of sheet paper P.

As a result, any sheet paper P is curled in the shape along the curved shape of nip portion 23 of which heat roller 20 side is curved in the concave shape. However, in the case of A4 and A3 size ordinary sheet paper P1 and P3, amount of curl of sheet paper P is small and in the case of A4R size thin ordinary sheet paper P or A4 size thick sheet paper P4, amount of curl becomes large. After fixed, a sheet paper P is passed through conveying guide 24 and the curl is corrected and discharged onto receiving tray 26. Guide belt 27 of conveying guide 24 conveys a sheet paper P with a toner image fixed thereon conveyed from fixing unit 22 while being cooled by the air blasted to the outer and inner surfaces from duct 36*a* by rotating in the arrow direction v.

In the case of A4 and A3 size ordinary sheet paper P1, P3, curl correction unit 37 is at the home position. Therefore, curl of sheet paper P1, P3 is corrected moderately while passing through conveying guide 24 that has a large curve angle and cooled and discharged on paper discharge tray 26 by paper discharge roller 26*a* without receiving a large curl correction force of curl correction roller 40. In the case of A4R size thin ordinary sheet paper P2, curl correction unit 37 is at the position shown in FIG. 3. Accordingly, sheet paper P2 receives a large correction force while clamped by guide belt 27 and curl correction roller 40 and conveyed along guide belt 27 that is curved by contacting curl correction roller 40, and curl corrected, cooled and discharged onto paper discharge tray by paper discharge roller 26*a*.

In the case of A4 size thick sheet paper P4, curl correction unit 37 is at the home position until the leading edge of sheet paper P4 reaches the position of curl correction roller 40 in conveying guide 24, and the leading edge of sheet paper P4 is smoothly conveyed between guide belt 27 and curl correction roller 40. When the leading edge of sheet paper P4 reaches curl correction roller 40, curl correction unit 37 moves to the position shown in FIG. 3 and sheet paper P4 is clamped by guide belt 27 and curl correction roller 40. Hereafter, sheet paper 4 receives a large correction force when clamped and conveyed by guide belt 27 and curl correction roller 40 along guide belt 27 that is curved by contacting curl correction roller 40. Then, the curl is corrected and the sheet paper is cooled and discharged onto paper discharge tray 26 by paper discharge roller 26*a*.

According to this embodiment, correction unit 37 of curved conveying guide 24 is rotated so as to change the conveying direction of sheet paper P to the horizontal direction from the vertical direction after fixing an image and thus, it becomes possible to change the curve angle of the conveying guide by bending guide belt 27 according to amount of curl produced on sheet paper P at the time of fixing. Therefore, disregarding difference in size, material and the like, the curl of sheet paper P can be properly corrected according to its amount of curl. Thus, sheet paper P can be stacked uniformly on paper discharge tray 26 without disturbing succeeding paper discharge.

Further, since belt guide 27 is cooled by the air blasting from duct 36*a,* it is possible to prevent the temperature of conveying guide 24 provided above fixing unit 22 from rising and furthermore, make sheet paper P cool positively, accelerate the fixing of a toner image while sheet paper P passes through conveying guide 24 and prevent sheet paper P stacked in paper discharge tray 26 from adhering to each other for viscosity.

Further, in the case of A4 size thick sheet paper P4, after its leading edge reaches the position of curl correction roller 40 after fixing an image, curl correction roller 40 is moved so as to make a curve angle of guide belt 27 deep. Therefore, even when thick sheet paper is conveyed in the vertical direction, sheet paper P4 can be easily advanced to the position of guide belt 27. Thus, the conveyance of sheet paper P4 is prevented from stalling at the position of conveying guide 24 and curl can be properly corrected while maintaining a good conveying performance.

Furthermore, curl correction unit 37 is capable of arranging sheet paper P at the curved portion of conveying guide 24 utilizing its curved portion and it is therefore possible to downsize the unit without necessity for securing a straight line shape space before and after, for instance, conveying guide 24 for correcting sheet paper curve.

This invention is not restricted to the embodiment described above but can be variously modified within its spirit and scope. For example, an image forming apparatus may be a color image forming apparatus or a duplex surface image forming apparatus and size, material and the like of using recording media are not restricted. Further, the conveying direction of recording media by the conveying guide is also not limited to the horizontal direction from the vertical direction. In addition, the construction of a curl correction unit is not limited when the curve angle of the conveying guide is variable, and an angle of the curl correction unit that is curved is not restricted when it is within the correctable range of curl of recording media.

According to this invention as described above in detail, it is possible to properly correct amount of curl of recording media irrespective of various image forming conditions, convey and discharge recording media satisfactorily by changing the angle of curve of the conveying guide according to amount of curl of recording media. Further, no exclusive space is needed for the curl correction as curl of recording media can be corrected utilizing the curve of the conveying guide and downsizing of an apparatus is enabled. Further, the fixing of toner image is accelerated while recording media pass through the conveying guide, adhesion of stacked sheet paper P for sheet paper P that are still viscous can be prevented when discharging them and sheet paper can be discharged satisfactorily. In the case of recording media that are inferior in conveying performance, they can be prevented from being delayed by changing the curving angle of the conveying guide after conveying of recording sheet progresses and curl can be corrected properly and recording sheet can be conveyed satisfactorily.

What is claimed is:

1. An image forming apparatus comprising:

a developing image forming unit to form unfixed toner images on recording media;

a fixing unit to heat, pressurize and fix unfixed toner images on the recording media having the unfixed toner images while conveying the recording media in a first direction by clamping them with a curved nip portion;

a conveying guide provided at the downstream of the fixing unit and curved in the direction reverse to the curve of the nip portion to guide the recording media in a second direction crossing the first direction;

a stacking portion to stack the recording media guided by the conveying guide; and a curl correction unit to change an angle of curve of the conveying guide by contacting the conveying guide and adjusting a contacting force with the conveying guide, wherein the curl correction unit has a rotatable lever, a curl correction roller that is attached to the tip of the lever and is brought in contact with the recording media from the axial direction of the curve of the conveying guide, and a rotating mechanism that rotates the lever.

2. The image forming apparatus according to claim 1, wherein the first direction is a vertical direction and the second direction is a horizontal direction.

3. The image forming apparatus according to claim 1, wherein the contacting force of the curl correction unit with the conveying guide is set according to the characteristics of the recording media.

4. The image forming apparatus according to claim 1, wherein the contacting force of the curl correction unit with the conveying guide is set according to the fixing characteristics of a toner image formed on the developing image forming unit.

5. The image forming apparatus according to claim 1, wherein the contacting force of the curl correction unit with the conveying guide is set according to the fixing characteristics of the fixing unit.

6. The image forming apparatus according to claim 1, wherein the curl correction unit is brought in contact with the conveying guide after the leading edge of the recording media passes between the conveying guide and the curl correction unit.

7. The image forming apparatus according to claim 1, wherein the conveying guide has the guide belt that rotates in the guide direction and the curl correction unit changes the angle of curve of the guide belt.

8. An image forming apparatus comprising:

a developing image forming unit to form unfixed toner images on recording media;

a fixing unit to heat, pressurize and fix unfixed toner images on recording media having the unfixed toner images while conveying the recording media in a first direction by clamping them with a curved nip portion;

a conveying guide provided at the downstream of the fixing unit and curved in a direction reverse to the curve of the nip portion to guide the recording media in a second direction crossing the first direction;

a fan to cool the recording media while conveying the recording media in the conveying guide;

a stacking portion to stack the recording media guided by the conveying guide and cooled by the fan; and a curl correction unit to change an angle of curve of the conveying guide by contacting the conveying guide and adjusting a contacting force with the conveying guide, wherein the curl correction unit has a rotatable lever, a curl correction roller that is attached to the tip of the lever and is brought in contact with the recording media from the axial direction of the curve of the conveying guide, and a rotating mechanism that rotates the lever.

9. The image forming apparatus according to claim 8, wherein the first direction is a vertical direction and the second direction is a horizontal direction.

10. The image forming apparatus according to claim 8, wherein the contacting force of the curl correction unit with the conveying guide is set according to characteristics of the recording media.

11. The image forming apparatus according to claim 8, wherein the contacting force of the curl correction unit with the conveying guide is set according to fixing characteristics of a toner image formed on the developing image forming unit.

12. The image forming apparatus according to claim 8, wherein the contacting force of the curl correction unit with the conveying guide is set according to fixing characteristics of the fixing unit.

* * * * *